US005630297A

United States Patent [19]

Rutherford

[11] Patent Number: 5,630,297

[45] Date of Patent: May 20, 1997

[54] UNIVERSAL WEEP SCREED

[75] Inventor: Barry Rutherford, Chatsworth, Calif.

[73] Assignee: Flannery, Inc., San Fernando, Calif.

[21] Appl. No.: 547,245

[22] Filed: Oct. 24, 1995

[51] Int. Cl.[6] ..... E04B 1/62

[52] U.S. Cl. ..... 52/58; 52/98; 52/371

[58] Field of Search ..... 52/58, 59, 60, 52/61, 62, 98, 101, 97, 254, 255, 371, 256

[56] References Cited

U.S. PATENT DOCUMENTS

| | | | |
|---|---|---|---|
| 537,720 | 10/1895 | O'Keeffe et al. | 52/58 |
| 1,379,516 | 5/1921 | Benjamin | 52/62 |
| 1,624,121 | 4/1927 | Thiem | 52/371 |
| 1,886,320 | 11/1932 | Waite | 52/254 |
| 1,958,622 | 5/1934 | Herman | 52/60 |
| 3,309,825 | 3/1967 | Zinn et al. | 52/371 X |
| 4,185,433 | 1/1980 | Cantrell | 52/404 |
| 4,289,818 | 9/1981 | Casamayor | 52/98 X |

FOREIGN PATENT DOCUMENTS

| | | | |
|---|---|---|---|
| 521482 | 3/1931 | Germany | 52/58 |
| 608896 | 5/1978 | U.S.S.R. | 52/61 |

OTHER PUBLICATIONS

AMICO, Vinyl Accessory Products, Drywall, Veneer & Stucco. 1993.

*Primary Examiner*—Carl D. Friedman
*Assistant Examiner*—Laura A. Saladino
*Attorney, Agent, or Firm*—Christie, Parker & Hale, LLP

[57] ABSTRACT

A weep screed for use in exterior construction has a vertical member, an outwardly projecting member, and an inwardly projecting member which is susceptible of being form-fit to a concrete foundation. The inwardly projecting member has a plurality of grooves or notches running along the length of the weep screed to provide tear strips, to permit adjustability of the length of the inwardly projecting member by allowing it to be torn off, or to permit bending of the inwardly projecting member for a form fit with the foundation where a flush fit occurs at a point in between tear strips.

12 Claims, 2 Drawing Sheets

UNIVERSAL WEEP SCREED

FIELD OF THE INVENTION

The present invention relates to a weep screed, and in particular, a plastic member for attachment along the base of a structure to prevent moisture from entering between the structure and a foundation below the structure.

BACKGROUND OF THE INVENTION

In the construction art it is common to use a weep screed of sheet metal at the base of exterior walls of a structure to help support an exterior coating and to provide a barrier to water entering between the exterior walls and foundation of the structure. It is also theorized that stucco may absorb some water which can then "weep" out of the exterior wall. It has also become common to apply a shear panel to the exterior framing of the structure for seismic or other reinforcement reasons particularly since the 1971 Sylmar earthquake in California. This shear panel is typically made of plywood and is attached to the framing of the structure just above its foundation, which is typically concrete. In the ordinary case, a footprint of the shear panel extends wholly or partly beyond the concrete foundation. When a sheer panel is used, the weep screed is applied to the base of the sheer panel. The exterior surface which is then applied to the shear panel and weep screed does not cover the bottom edge of the shear panel.

It has become a problem with this type of construction scheme that rain water, or sprinkler water or hose water can splash into the shear panel and still plate from below. The weep screed has a vertical attachment member, then a first member which is outwardly protruding and angled downward, a second member protruding from the first member back toward the concrete foundation, and a third member extending downwardly from the end of the second member. The first member aids in supporting the exterior coating surface. Any water which comes into contact with the exterior coating surface which may be absorbed into the surface and possibly also into the building layers underneath the surface can drain downwardly and weep from the structure along the edge of the weep screed. This weep screed also helps to reduce the amount of moisture which comes into contact with the shear panel, in particular, the bottom edge of the shear panel. This is desirable as moisture can be absorbed by the shear panel causing warping and swelling of the panel, with a resultant cracking or deformation of the exterior coating surface.

Although weep screeds are somewhat effective in minimizing the amount of moisture absorbed by the shear panel, their design is such that a significant gap exists between the lower portion of the weep screed and the concrete foundation due to the sheer panel, thus allowing rain water, sprinkler water or hose water, to be splashed between the foundation and the weep screed. This water can come into contact with the shear panel and be absorbed into the panel. While weep screeds are intended to reduce moisture absorption, a problem still exists, particularly in areas where water is permitted to accumulate near the edge of the structure. Moreover, as weep screeds were designed prior to widespread use of shear panels, the weep screeds provide no way to accommodate different gaps between the shear panel outer surface and the concrete slab's edge, due to different tolerances, different thickness shear panels, and other factors. Furthermore, weep screeds are currently made out of sheet metal which is subject to rusting over time.

SUMMARY OF THE INVENTION

The present invention provides for an improved weep screed having advantages over the current state of the art weep screeds. The invention provides for a longer lasting weep screed, which is more resistant to adverse environmental conditions. The universal weep screed provides a solution to problems presented by current weep screeds, most notably the gap which is present between the lower portion of the weep screed and a structure's foundation.

In accordance with the present invention, a weep screed has a flat vertical attachment section, an outwardly projecting section from the bottom of the vertical section and a lower section which projects inwardly. The vertical section is mounted to the shear panel. The inwardly projecting section projects back toward the foundation. To provide for a snug fit, even when shear panels of varying widths and imperfections are used, and even when the foundation is not of uniform condition, the inwardly protruding member is provided with a set of parallel grooves or notches which can be used as break offs to adjust its length. The weep screed in the preferred embodiment is made of a flexible but impermeable material, i.e., plastic, such as exterior grade vinyl. The material is not susceptible to oxidation in the manner that typical prior-art weep screeds made of sheet metal are. Moreover, a flexible material allows for a snug fit with the foundation.

Finally, an additional advantage of the present invention is that by eliminating the gap between the foundation and weep screed, the shear panel is at least partially protected from termites and other insects which could otherwise have access to and damage the shear panel and the structure as a whole.

DETAILED DESCRIPTION OF THE PREFERRED EMBODIMENT

Figure 1:
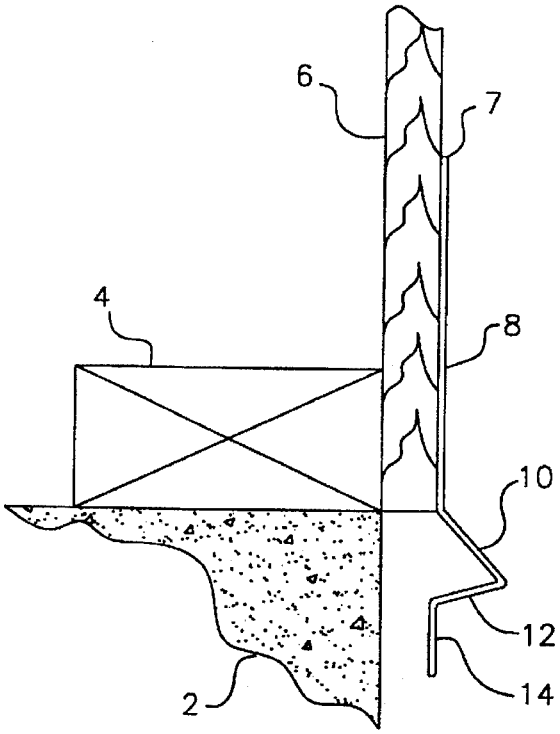
FIG. 1 PRIOR ART
FIG. 1 is a cross-sectional view of a prior-art weep screed shown in context.

Referring to the drawings, specifically FIG. 1 which shows a cross-sectional view of a prior-art weep screed, there is shown a foundation slab 2, typically made of concrete. Situated on top of slab 2 is a framing member 4, which is typically a 2×4 in structures such as residential homes. The edge of the framing member is flush with the edge of the slab. In areas with seismic activity, it is often desirable or necessary to mount a shear panel 6 on the exterior of the framing member to strengthen the walls which may have been damaged by an earthquake. Sometimes reinforcement is performed even if the structure has not been damaged. After attaching shear panels, an exterior coating surface such as stucco, with appropriate layers of additional materials, such as building paper and/or wire lath is applied to it. Typically, the shear panel is made of plywood such as one-half inch thick plywood. Weep screeds as shown in FIG. 1 were developed to provide a theoretically improved way of draining absorbed moisture from the exterior coating surface and also to provide additional support for the coating surface.

It was seen, however, as the shear panel was near the exterior soil it would become wet from exposure to moisture on the soil surface. (The Uniform Building Code requires only 2' minimum between the stucco bottom and concrete or pavement and only 4' minimum between the stucco and soil.) Due to the shear panel causing the weep screed to have a gap between it and the foundation, rain water, hose water and sprinkler water could and would still splash between the foundation and the weep screed and come into contact with the shear panel or sill plate. This water would be absorbed by the shear panel causing warping of the panel and subsequent cracking or degradation of the exterior coating even with application of a weep screed. As seen with a weep screed as shown in FIG. 1, the weep screed 7 has a vertically extending attachment member 8, an outwardly projecting member 10 which projects downwardly at an angle, an inwardly projecting member 12 which also projects downwardly at an angle, and a subterranean vertical member 14 which projects directly downward and is co-linear with the attachment member 8.

As is shown in FIG. 1, splashed rain, sprinkler, hose or other water still has access to the lower edge of the shear panel. This ground water can be absorbed by the shear panel, thus causing the same warping and cracking problems as discussed above. Because the thickness of the shear panel is neither uniform in the construction art nor uniform with respect to a particular construction site or with respect to a single panel, and because the concrete foundation slab itself suffers from imperfections, it is impossible to fashion weep screeds which could consistently eliminate a gap between the subterranean vertical member and the concrete foundation without custom fabrication of the weep screed. Moreover, because the prior art weep screed is made from sheet metal, it is difficult to bend the weep screed in order to minimize or eliminate the gap between the subterranean vertical member and the foundation slab. This gap is normally at least ½ inch or more.

Figure 2:
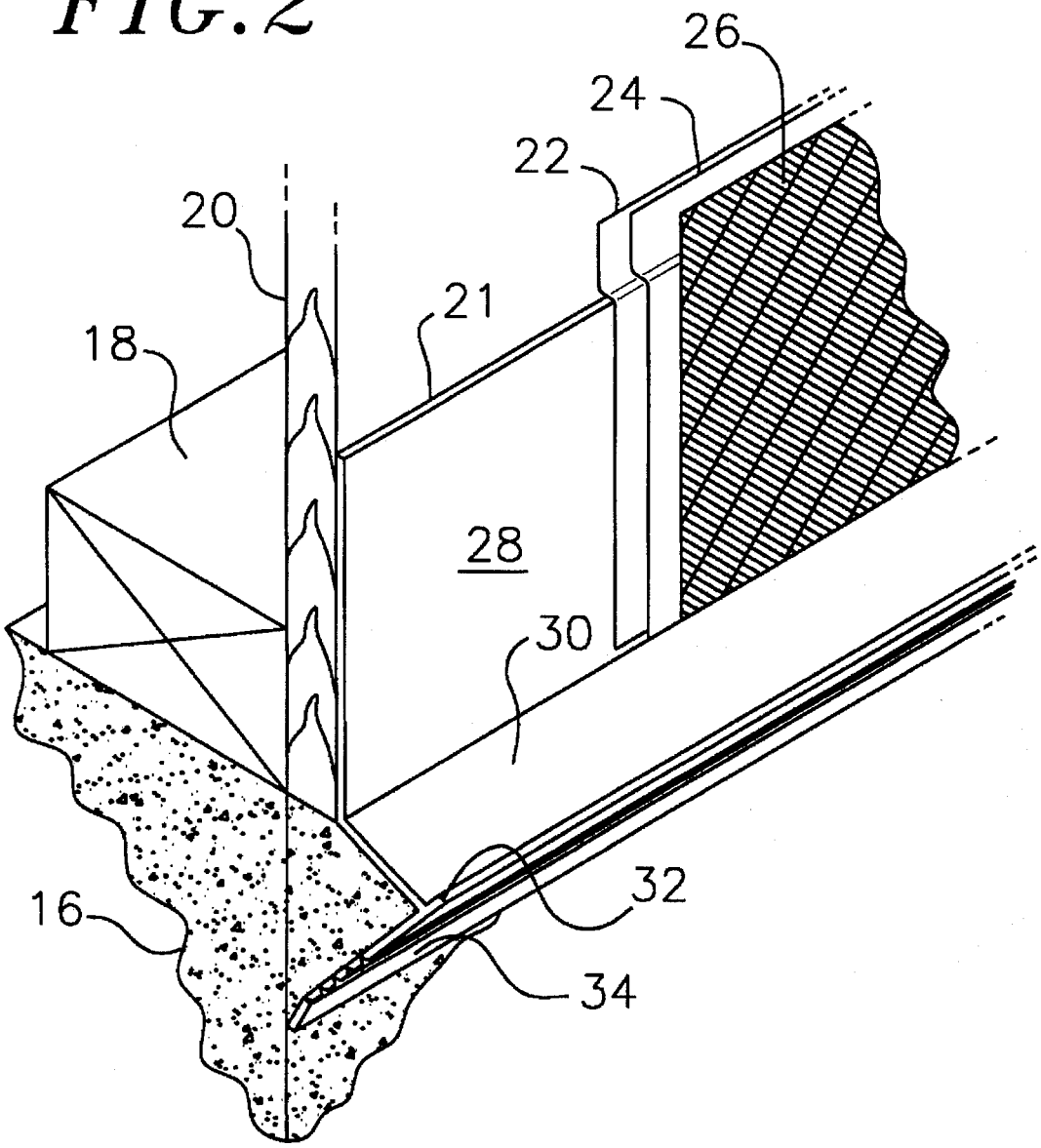
FIG. 2 is a perspective sectional view of a universal weep screed made in accordance with the present invention, shown in context.

Thus, the need for a weep screed mad according to the present invention is shown. Referring now to FIG. 2, the cutaway perspective view shows a concrete foundation slab 16, an exemplary framing member 18 and an exemplary shear panel 20 which extends beyond the footprint of the foundation slab. Mounted on the exterior of the shear panel 20 is a weep screed 21 made according to the present invention. Mounted on the shear panel and the weep screed 21 are two layers of building paper 22 and 24 and a layer of wire lath 26 as exemplary of a typical base for an exterior coating.

The weep screed 21 has a vertical member 28, an outwardly projecting member 30, an upwardly projecting lip 32, and an inwardly projecting member 34. The weep screed 21 is typically made of a plastic such as exterior grade vinyl which is flexible yet impermeable to air and water. The exterior grade vinyl used to fashion the weep screed has a typical thickness of 0.060 of an inch. A weep screed made of exterior grade vinyl, as is herein shown to be desirable with weep screeds, is not susceptible to rust or other environmental degradations in the manner that a weep screed made of sheet metal is. According to the Universal Building Code, this vertical member 28 is required to have a length of at least 3½ inches.

The weep screed 21 can be made of any horizontal length suitable for use on an exterior wall of a structure. Typically, they will be prefabricated in set lengths and may be cut to fit the structure on which the weep screed is to be applied. Conversely, two or more weep screeds may be used adjoining one another on a side of a structure which is longer than the prefabricated length of the weep screed.

The weep screed 21 has an outwardly projecting member 30 which projects downwardly at an angle. The outward projection of the member is designed to support the bottom of the exterior coating (stucco). The weep screed also has an upwardly projecting lip 32 which extends along the full length of the weep screed. The upwardly projecting lip, which is not needed, helps provide further support for the stucco which rests on the outwardly projecting member and the upwardly projecting lip. The inwardly projecting member 34 extends inwardly at least as far as the concrete foundation slab 16. The inwardly projecting member is fashioned with several grooves which run along its entire length. These grooves, as will be explained in greater detail below in reference to FIG. 3, permit adjustability of the length of the inwardly projecting member by breaking off or folding the extra length and for form fitting the length of the inwardly projecting member to fit flush with the concrete slab 16. By permitting the inwardly projecting member to fit flush with the concrete slab 16, the present invention prevents splashing of rain water and other water from reaching the shear panel and coming in contact therewith.

By eliminating the gap present in the prior art, the present invention diminishes or eliminates any swelling of the shear panel which causes cracking of the exterior surface. As the weep screed is made of a flexible material which is impermeable to water, such as exterior grade vinyl, its advantages over the prior art are clearly demonstrated. In addition, by providing for a flush fit between the concrete foundation and the inwardly projecting member, the present invention inhibits termites and other insects, which would otherwise have more ready access to the shear panel and to the structure of the building as a whole.

The present invention provides for adjustability in the length of the inwardly projecting member to compensate for different conditions in the concrete foundation, imperfections in the foundation along the outside edge of the building, and for imperfections and varying widths of shear panels when applied to the structure.

The present invention's utility with respect to applications where the shear panel or other structural member extend beyond the footprint of the foundation slab has been clearly shown. However, as will be seen with the adjustability of the universal weep screed, the weep screed can be applied where the structural members, for example shear panels, do not extend beyond the footprint of the foundation slab, and even when the structural members are inset from the edge of the foundation slab.

Figure 3:
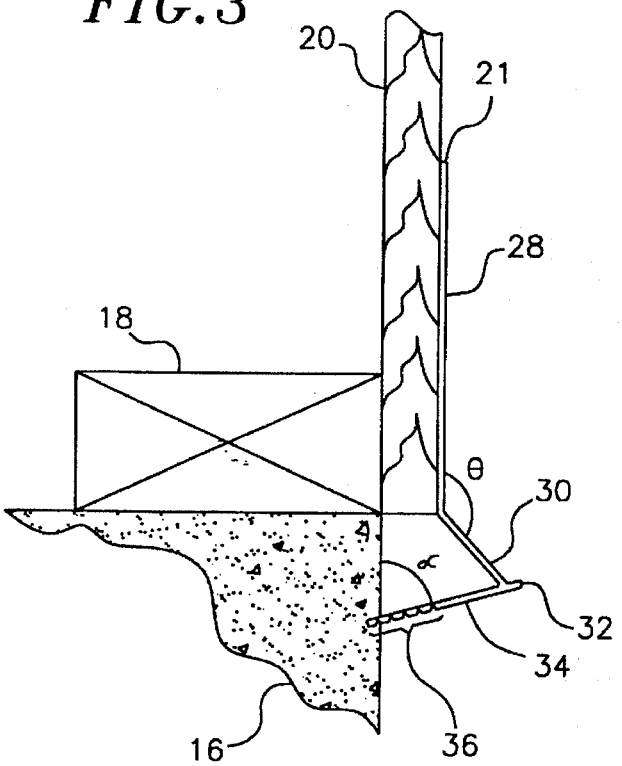
FIG. 3 is a cross-sectional view of a universal weep screed made in accordance with the present invention, shown in context.

Referring now to FIG. 3, this is a cross-sectional view of the weep screed 21 in context of the foundation slab 16, the framing member 18, and the shear panel 20. Shown are the weep screed 21 having a vertical member 28, outwardly projecting member 30 which projects downwardly at an angle $\theta$, an upwardly projecting lip 32, an inwardly projecting member 34 which projects inwardly at an angle $\alpha$, and a plurality of grooves or notches 36. These grooves 36 run the entire length of the prefabricated weep screed and preferably are evenly spaced to permit form fitting of the inwardly projecting member with the concrete foundation despite the presence of varying degrees of imperfections in the foundation and/or width of the shear panel.

Ideally, the inwardly projecting member will be situated flush with the concrete foundation at precisely one of the grooves or notches 36. If this is the case, the additional portion of the inwardly projecting member may be broken off and the inwardly projecting member will fit flush with the concrete foundation. If such is not the case, and the groove does not come at such a location as to permit precise form fitting of the inwardly projecting member with the concrete foundation, the grooves provide a scoring mechanism by which the inwardly projecting member can be bent along the length of the weep screed to thereby permit form fitting of the weep screed and the inwardly projecting member thereof to the concrete foundation. FIG. 3 illustrates the weep screed 21 having the inwardly projecting member 34 projecting against the foundation slab before the inwardly projecting member is modified, by breaking off or bending a section of the member at one of the grooves 36, to provide a flush fit against the concrete foundation.

The weep screed is then held in a flush position with the concrete foundation by means of a friction fit, as the vertical member is attached to the shear panel and the weep screed is made of a rigid yet flexible material.

The adjustability of the weep screed functions equally well when the shear panel or other structural member does not extend beyond the footprint of the foundation slab. When the exterior surface of a structural member is set in from the edge of the foundation slab, the grooves on the inwardly projecting member meet the goal of allowing a snug fit with the foundation slab equally well.

Before installation measure the distance between the outer most point from the face of the plywood sheer panel or framing to the concrete foundation. Once you have determined this distance the excess if any should be removed. Simply bend that portion to be removed along the desired score line towards the back side of the vertical flange, this will start the tear strip. Simply by pulling the excess in the same direction as above the strip is removed following the scored line that has been previously selected.

The bottom of the vertical nailing flange must terminate at the bottom of the sill plate or the bottom of the plywood sheer panel. This procedure will ensure a tight connection between the bottom fange of the weep screed and the foundation.

The outwardly projecting member 30 projects downwardly at an angle θ which is sufficiently outward to provide direction to the rain and/or absorbed water as it flows along the weep screed away from the shear panel and the foundation as well as sufficiently outward to aid in supporting the exterior coating surface. Virtually any angle greater than 90 degrees and less than 180 degrees will serve this purpose, however, in a preferred embodiment of the invention, this angle θ is 135° downwardly from the vertical member. The inwardly projecting member 34 projects inwardly at an angle which is slightly downward from the vertical, however, any acute angle will serve the function appropriately, and the inwardly projecting member can even be substantially perpendicular to the foundation. In a preferred embodiment of the invention, the angle α is 70° from the projection of the vertical member. For a preferred embodiment, the horizontal distance between grooves is about one-eighth inch to accommodate different thicknesses of plywood which are usually measured in one-eighth inch increments. For example, a weep screed has a vertical section of 3.5 inches, with an additional vertical projection of about 12.5 inches for the outwardly and inwardly projecting members, a horizontal projection of the outwardly projecting member of about ¾ inch and a horizontal projection of the inwardly projecting member of about 1½ inches (to fill gaps up to about a ¾ inch gap), with grooves beginning at ⅞ inch horizontal distance from the lip and continuing every horizontal distance of ⅛ inch to the end of the inwardly projecting member, located at about 1.5 inches horizontally from the lip.

The measurements given herein are preferred and thus all other suitable measurements will come within the spirit and scope of the invention.

What is claimed is:

1. A weep screed comprising:

a vertical member;

an outwardly projecting member extending at an obtuse angle from the vertical member; and an inwardly projecting member that extends downwardly from an end of the outwardly projecting member at an acute angle with respect to the vertical member, and that includes a deformable portion adjacent a free end of the inwardly projecting member that extends beyond a plane defined by the vertical member, the inwardly projecting member including one or more grooves along the length of the weep screed that define the deformable portion.

2. The weep screed of claim 1 wherein the weep screed is made of plastic.

3. The weep screed of claim 1 additionally comprising an upwardly projecting lip at a junction of the outwardly projecting member and the inwardly projecting member.

4. The weep screed of claim 1 wherein said grooves are of a sufficient depth for permitting the deformable portion of the inwardly projecting member to be bent or broken off along the groove.

5. The weep screed of claim 1 wherein said grooves are evenly spaced along the inwardly projecting member.

6. The weep screed of claim 1 wherein said grooves are of a sufficient depth to permit bending the deformable portion of the inwardly projecting member to form fit the inwardly projecting member to a foundation.

7. The weep screed of claim 1 wherein the inwardly projecting member projects horizontally at least one-half inch beyond the vertical member with respect to the outwardly projecting member.

8. The weep screed of claim 6 wherein the deformable portion of the inwardly projecting member is adapted to seal against the foundation when form fit thereto.

9. The weep screed of claim 1 wherein the weep screed is made of exterior grade vinyl.

10. A weep screed comprising:

a vertical member;

an outwardly projecting member that extends downwardly away from an end of the vertical member;

an inwardly projecting member that extends downwardly away from an end of the outwardly projecting member opposite the vertical member, the inwardly projecting member having a free end that extends beyond a plane defined by the vertical member;

an upwardly projecting lip extending outwardly away from junction between the outwardly projecting member and the inwardly projecting member, and extending along a horizontal length of the weep screed; and one or more grooves disposed along a length of the inwardly projecting member wherein said grooves are of a sufficient depth to permit bending a portion of the inwardly projecting member to fit a portion of the inwardly projecting member against a foundation.

11. A weep screed installed onto a structure, the weep screed comprising:

a flat vertical member that is attached along one surface to an outside surface of a structural member of the structure that is disposed on a foundation;

an outwardly projecting member extending downwardly from an end of the vertical member, at an end of the structural member;

an inwardly projecting member extending downwardly from an end of the outwardly projecting member opposite the vertical member and toward a surface of the foundation;

one or more grooves along the length of the inwardly projecting member to facilitate bending or breaking a terminal portion of inwardly projecting member to provide a snug friction fit against an adjacent surface of the foundation;

wherein the structural member is disposed on the foundation so that the outside surface of the structural member is not collinear with the surface of the foundation.

12. A weep screed comprising:

a vertical member adapted for attachment to a structural member surface;

an outwardly projecting member extending downwardly away from an end of the vertical member;

an inwardly projecting member extending downwardly away from an end of the outwardly projecting member opposite the vertical member, the inwardly projecting member having:

a terminal end portion that extends beyond a plane defined by the vertical member; and at least one groove running along a horizontal length between the terminal end portion and the outwardly projecting member to facilitate adjusting a distance that the terminal end portion extends from the outwardly projecting member to provide a friction fit against a foundation surface; and an upwardly projecting lip extending outwardly away from a junction between the outwardly projecting member and the inwardly projecting member, and extending along a horizontal length of the weep screed.

* * * * *